US007475943B1

(12) United States Patent
Huang

(10) Patent No.: US 7,475,943 B1
(45) Date of Patent: Jan. 13, 2009

(54) CHAIR THAT IS DESIGNED ERGONOMICALLY TO SUPPORT A USER'S BACK SNUGLY AND COMPLETELY

(75) Inventor: Chih-Yang Huang, Hemei Township, Changhua County (TW)

(73) Assignee: Sheng Jia Sheng Co., Ltd., Changhua County (TW)

( * ) Notice: Subject to any disclaimer, the term of this patent is extended or adjusted under 35 U.S.C. 154(b) by 0 days.

(21) Appl. No.: 11/768,360

(22) Filed: Jun. 26, 2007

(51) Int. Cl.
*A47C 7/46* (2006.01)

(52) U.S. Cl. ..... 297/284.4; 297/353; 297/354.11

(58) Field of Classification Search ..... 297/284.1, 297/284.4, 353, 354.11
See application file for complete search history.

(56) References Cited

U.S. PATENT DOCUMENTS 2,558,171 A * 6/1951 Chesley ..... 297/284.4
4,007,962 A * 2/1977 Muller-Deisig ..... 297/354.12
5,104,189 A * 4/1992 Hanai et al. ..... 297/284.4
5,277,475 A * 1/1994 Brandes ..... 297/354.11
5,628,547 A * 5/1997 Matsumiya ..... 297/354.11
5,704,689 A * 1/1998 Kim ..... 297/301.4
6,749,261 B2 * 6/2004 Knoblock et al. ..... 297/284.4
6,843,530 B1 * 1/2005 Wu ..... 297/284.4
2002/0180250 A1 * 12/2002 Kinoshita et al. ..... 297/354.11

* cited by examiner

*Primary Examiner*—Peter R. Brown
(74) *Attorney, Agent, or Firm*—Alan Kamrath; Kamrath & Associates PA

(57) ABSTRACT

A chair includes a base, a seat mounted on the base, a support bracket mounted on the seat, an upper backrest having an upper portion pivotally mounted on the support bracket, and a lower backrest pivotally mounted on a lower portion of the upper backrest. Thus, when a user's back is rested on the upper backrest and the lower backrest, the upper backrest and the lower backrest are pivotable relative to the support bracket to rest on the user's upper and lower backs respectively to support the user's whole back snugly and completely to prevent the user's lower back from depending in the air so as to provide a comfortable sensation to the user.

15 Claims, 9 Drawing Sheets

CHAIR THAT IS DESIGNED ERGONOMICALLY TO SUPPORT A USER'S BACK SNUGLY AND COMPLETELY

BACKGROUND OF THE INVENTION

1. Field of the Invention

The present invention relates to a chair and, more particularly, to a chair having a net-shaped backrest structure to provide a ventilating effect to a user.

2. Description of the Related Art

A conventional chair 50 in accordance with the prior art shown in FIGS. 8 and 9 comprises a base 51, a seat 53 mounted on the base 51, a support post 52 mounted between the base 51 and the seat 53, a support bracket 55 mounted on the seat 53, and a backrest 54 mounted on the support bracket 55 and provided with a net-shaped bearing face 541. Thus, the bearing face 541 of the backrest 54 provides a ventilating effect to a user's back. However, the backrest 54 has a flat profile that does not correspond to the curve profile of the user's back so that the backrest 54 only supports the user's upper back and cannot support the user's lower back, and the user's lower back easily depends in the air, thereby easily causing an uncomfortable sensation to the user. In addition, the backrest 54 is not designed ergonomically so that the user's gesture is easily affected.

BRIEF SUMMARY OF THE INVENTION

In accordance with the present invention, there is provided a chair, comprising a base, a seat mounted on the base, a support bracket mounted on the seat, an upper backrest having an upper portion pivotally mounted on the support bracket, and a lower backrest pivotally mounted on a lower portion of the upper backrest.

The primary objective of the present invention is to provide a chair that is designed ergonomically to support a user's back snugly and completely.

Another objective of the present invention is to provide a chair, wherein when a user's back is rested on the upper backrest and the lower backrest, the upper backrest and the lower backrest are pivotable relative to the support bracket to rest on the user's upper and lower backs respectively to support the user's whole back snugly and completely to prevent the user's lower back from depending in the air so as to provide a comfortable sensation to the user.

A further objective of the present invention is to provide a chair, wherein the upper backrest and the lower backrest are designed ergonomically to calibrate the user's gesture.

A further objective of the present invention is to provide a chair, wherein the upper backrest is forced by the user's upper back and pivotable relative to the pivot shafts of the support bracket to adjust the contact angle between the upper backrest and the user's upper back, while the lower backrest is forced by the user's lower back and pivotable relative to the pivot stubs of the support arms of the upper backrest to adjust the contact angle between the lower backrest and the user's lower back as to provide a more comfortable sensation to the user.

A further objective of the present invention is to provide a chair, wherein the upper backrest is pivotable relative to the support backrest to rest on the stop blocks of the support bracket to prevent an excessive movement of the upper backrest relative to the support bracket.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
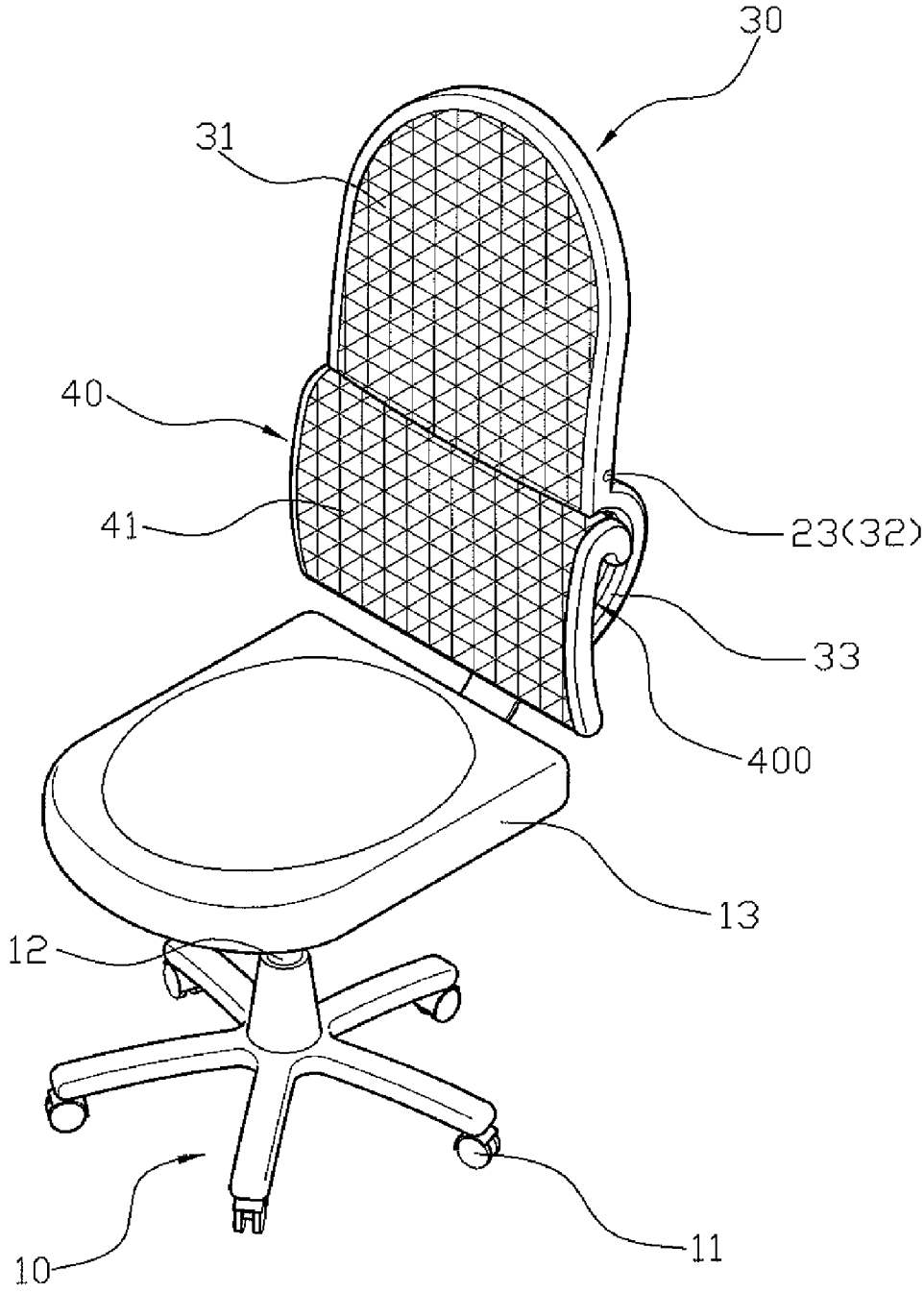
FIG. 1 is a perspective view of a chair in accordance with the preferred embodiment of the present invention.
Figure 2:
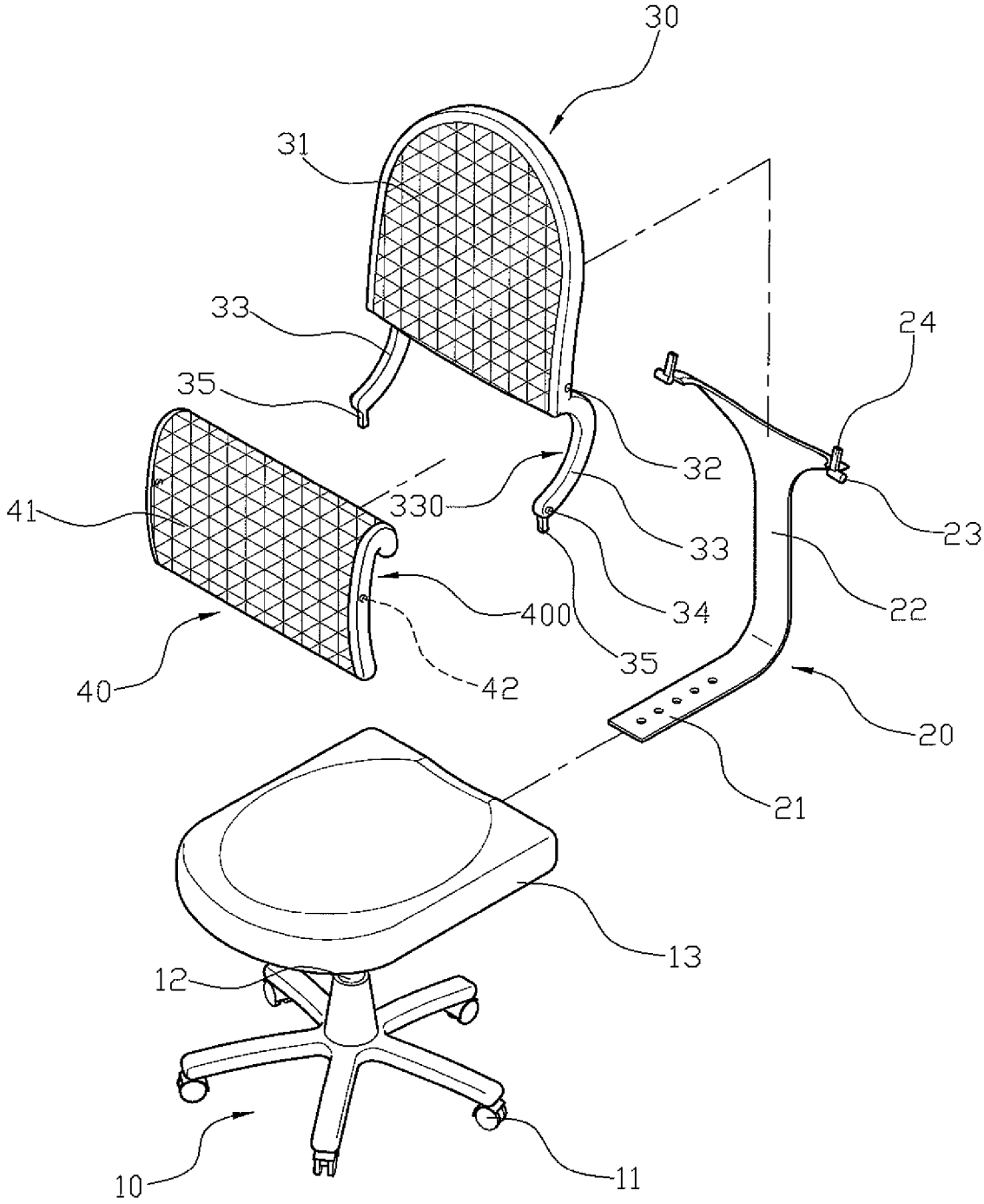
FIG. 2 is a partially exploded perspective view of the chair as shown in FIG. 1.
Figure 3:
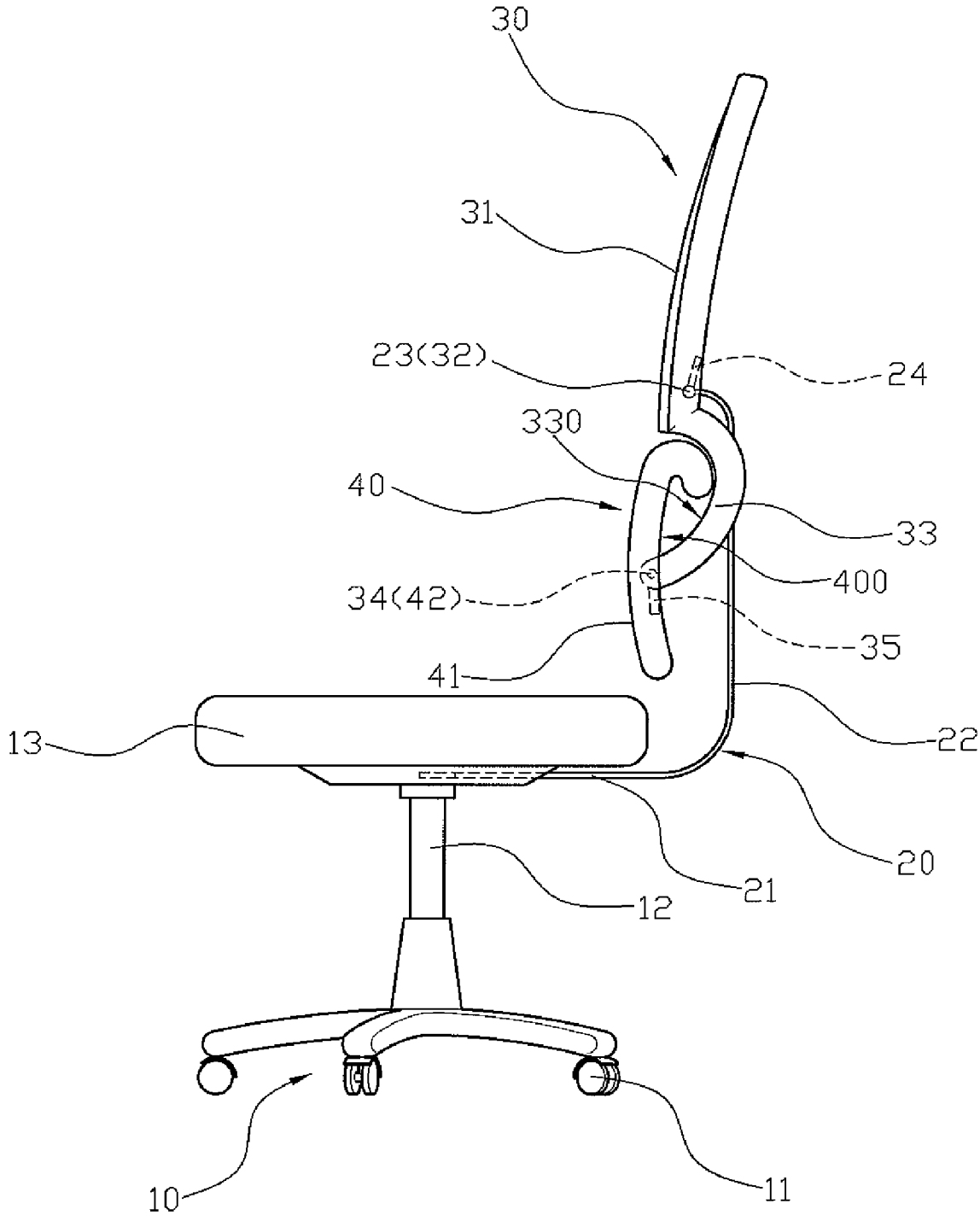
FIG. 3 is a side view of the chair as shown in FIG. 1.

Referring to the drawings and initially to FIGS. 1-3, a chair in accordance with the preferred embodiment of the present invention comprises a base 10, a seat 13 mounted on the base 10, a support bracket 20 mounted on the seat 13, a support post 12 mounted between the base 10 and the seat 13, a plurality of castors 11 mounted on a bottom of the base 10, an upper backrest 30 having an upper portion pivotally mounted on the support bracket 20, and a lower backrest 40 pivotally mounted on a lower portion of the upper backrest 30.

The support bracket 20 is substantially L-shaped sheet plate and has a first end formed with a horizontal fixing portion 21 secured to the seat 13 and a second end formed with an upright support portion 22. The support portion 22 of the support bracket 20 has an upper end provided with two opposite outwardly protruding pivot shafts 23 and two opposite upwardly protruding stop blocks 24 each perpendicular to a respective pivot shaft 23. Each of the stop blocks 24 of the support bracket 20 is disposed at an inclined state relative to the support portion 22 of the support bracket 20 and is inclined reward relative to the upper backrest 30.

The upper backrest 30 has a mediate portion pivotally mounted on the support portion 22 of the support bracket 20. The mediate portion of the upper backrest 30 is located between the upper portion and the lower portion of the upper backrest 30 and has two opposite sides each formed with a pivot hole 32 pivotally mounted on a respective pivot shaft 23 of the support bracket 20. The upper backrest 30 is pivotable relative to the support portion 22 of the support bracket 20 to rest on the stop blocks 24 of the support bracket 20 to prevent an excessive movement of the upper backrest 30 relative to the support portion 22 of the support bracket 20. The upper portion of the upper backrest 30 is provided with a net-shaped bearing face 31. The lower portion of the upper backrest 30 is provided with two opposite support arms 33. Each of the support arms 33 of the upper backrest 30 is substantially arc-shaped and has an opening 330 directed toward the lower backrest 40. Each of the support arms 33 of the upper backrest 30 has a distal end provided with an outwardly protruding pivot stub 34 and a downwardly protruding catch block 35 perpendicular to the pivot stub 34. The catch block 35 of each of the support arms 33 of the upper backrest 30 is inclined reward relative to the lower backrest 40.

The lower backrest 40 is pivotable relative to the upper backrest 30 when the upper backrest 30 is pivotable relative to the support bracket 20. The lower backrest 40 is pivotally mounted on the support arms 33 of the upper backrest 30 and has two opposite sides each formed with a pivot bore 42 pivotally mounted on the pivot stub 34 of a respective support arm 33 of the upper backrest 30. The pivot bore 42 of the lower backrest 40 is located at a middle position of the lower backrest 40. The lower backrest 40 is provided with a net-shaped bearing face 41 corresponding to and flush with the bearing face 31 of the upper backrest 30. The lower backrest 40 is substantially arc-shaped and has an opening 400 directed toward the support arms 33 of the upper backrest 30. The lower backrest 40 is pivotable relative to the support arms 33 of the upper backrest 30 to rest on the catch block 35 of each of the support arms 33 of the upper backrest 30 to prevent an excessive movement of the lower backrest 40 relative to the support arms 33 of the upper backrest 30.

Figure 4:
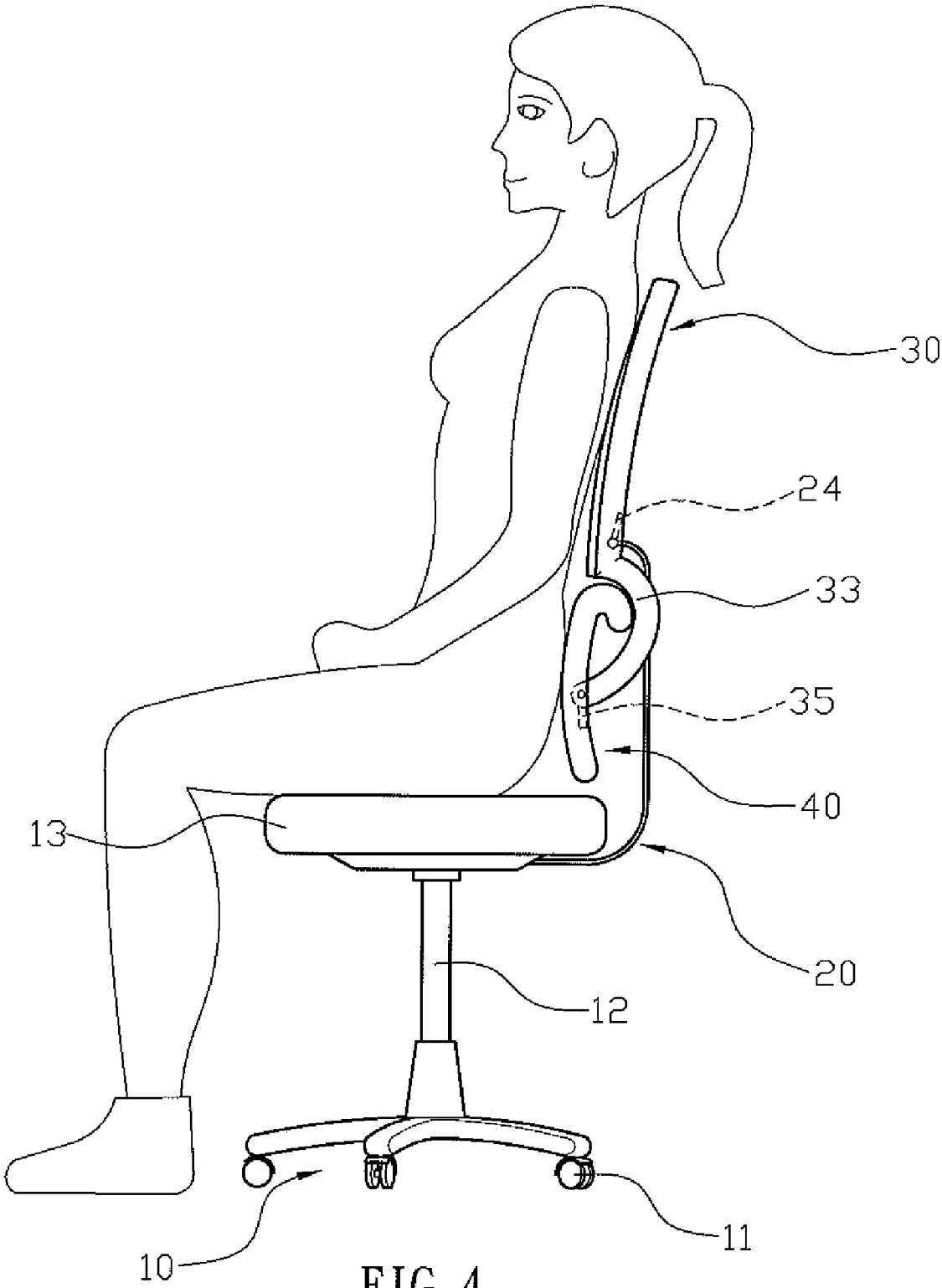
FIG. 4 is a schematic operational view of the chair as shown in FIG. 3.
Figure 5:
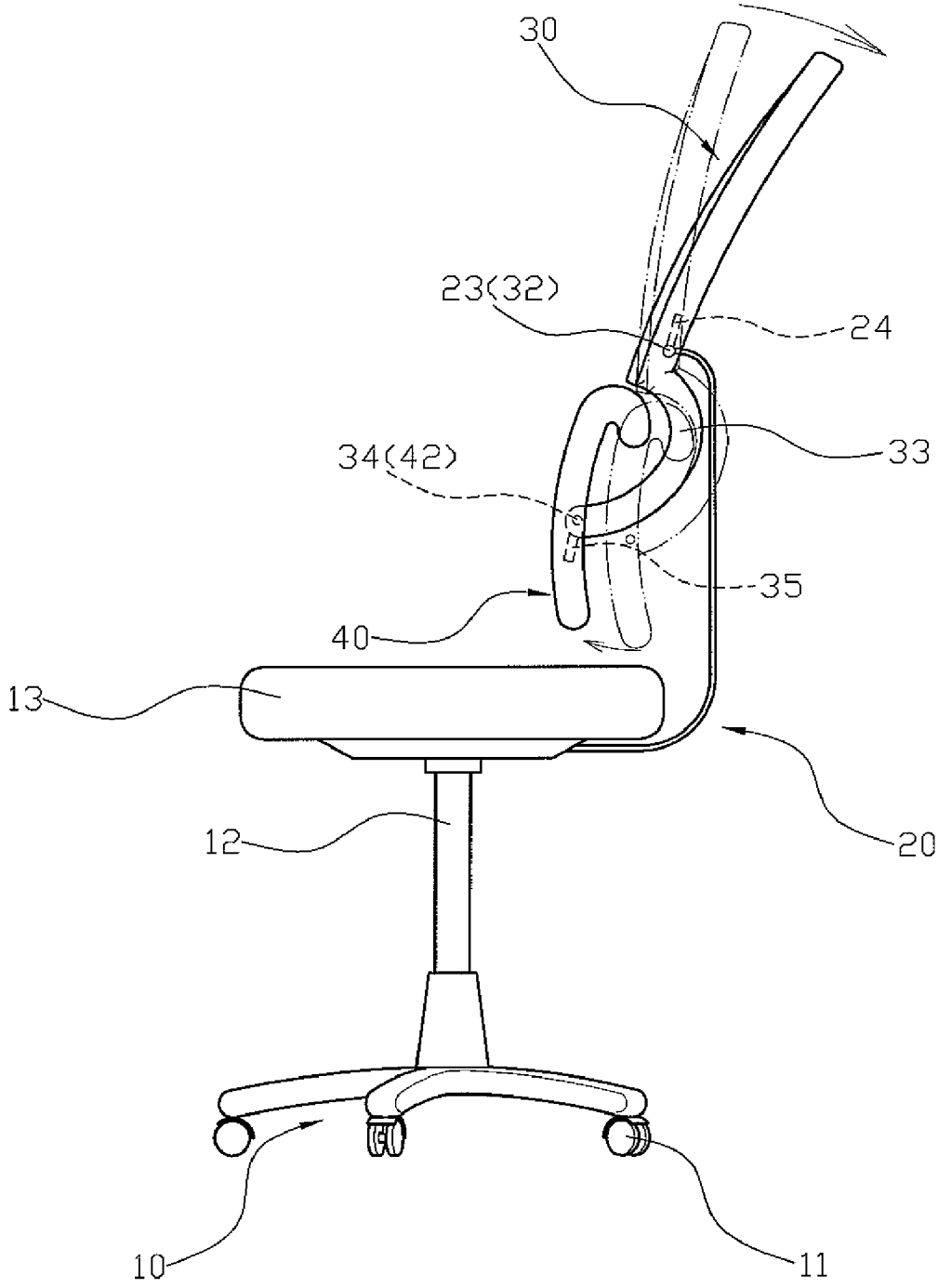
FIG. 5 is a schematic operational view of the chair as shown in FIG. 3.
Figure 6:
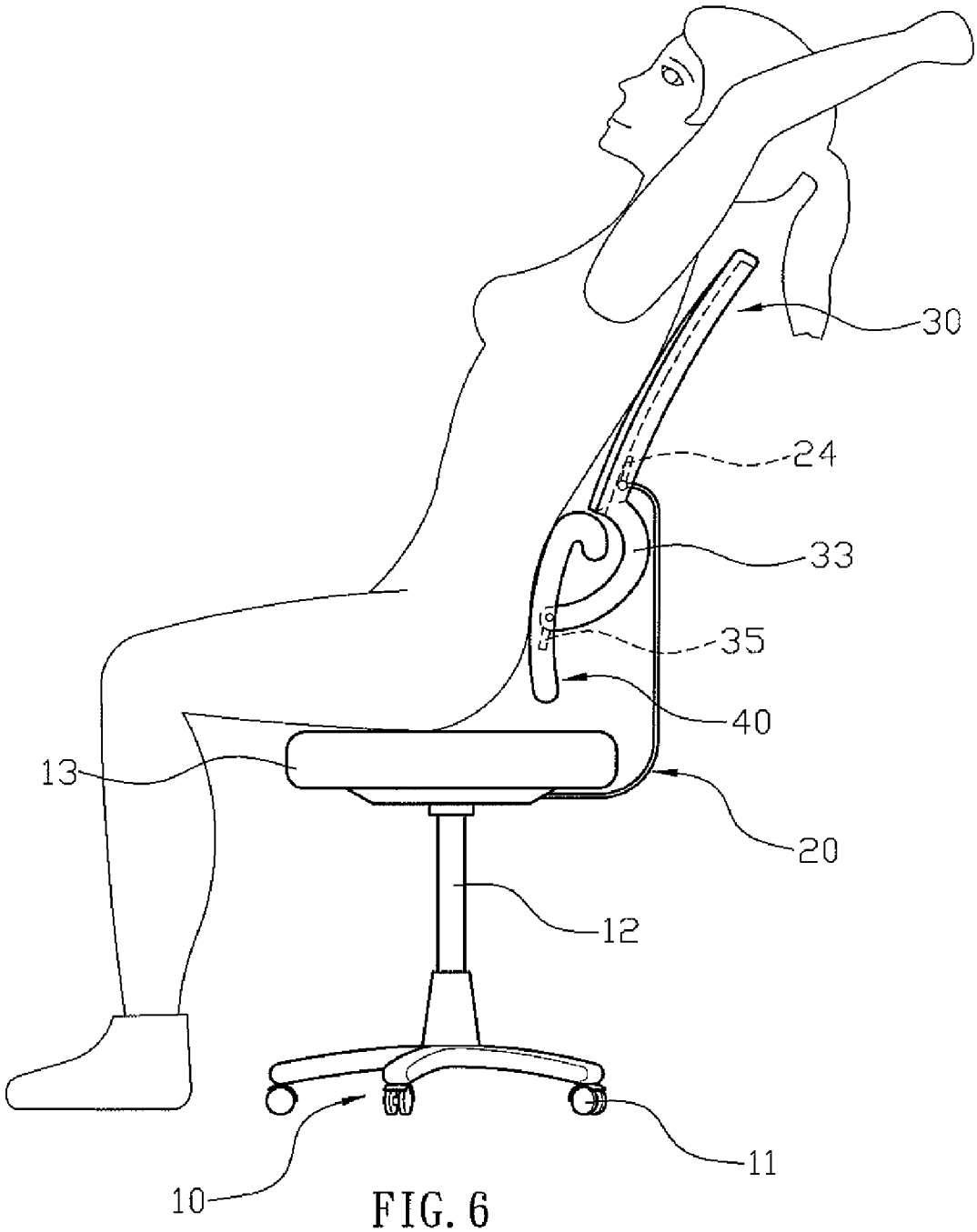
FIG. 6 is a schematic operational view of the chair as shown in FIG. 4.

In operation, referring to FIGS. 4-6 with reference to FIGS. 1-3, when a user's upper back is rested on the bearing face 31 of the upper backrest 30, the upper portion of the upper backrest 30 is forced by the user's weight and movable rearward relative to the support bracket 20 to pivot the upper backrest 30 relative to the pivot shafts 23 of the support bracket 20, and the lower portion of the upper backrest 30 is movable forward relative to the support bracket 20 to move the lower backrest 40 forward relative to the support bracket 20 so that the bearing face 41 of the lower backrest 40 is movable forward to rest on the user's lower back. Thus, the upper backrest 30 and the lower backrest 40 support the user's whole back to prevent the user's lower back from depending in the air so as to provide a comfortable sensation to the user. At this time, the upper backrest 30 is forced by the user's upper back and pivotable relative to the pivot shafts 23 of the support bracket 20 to adjust the contact angle between the upper backrest 30 and the user's upper back, while the lower backrest 40 is forced by the user's lower back and pivotable relative to the pivot stubs 34 of the support arms 33 of the upper backrest 30 to adjust the contact angle between the lower backrest 40 and the user's lower back as to provide a more comfortable sensation to the user. In addition, the bearing face 31 of the upper backrest 30 and the bearing face 41 of the lower backrest 40 provide a ventilating effect to the user's back.

As shown in FIG. 6, the upper backrest 30 is pivotable relative to the support portion 22 of the support bracket 20 to rest on the stop blocks 24 of the support bracket 20 to prevent an excessive movement of the upper backrest 30 relative to the support portion 22 of the support bracket 20. In addition, the lower backrest 40 is pivotable relative to the support arms 33 of the upper backrest 30 to rest on the catch block 35 of each of the support arms 33 of the upper backrest 30 to prevent an excessive movement of the lower backrest 40 relative to the support arms 33 of the upper backrest 30.

Figure 7:
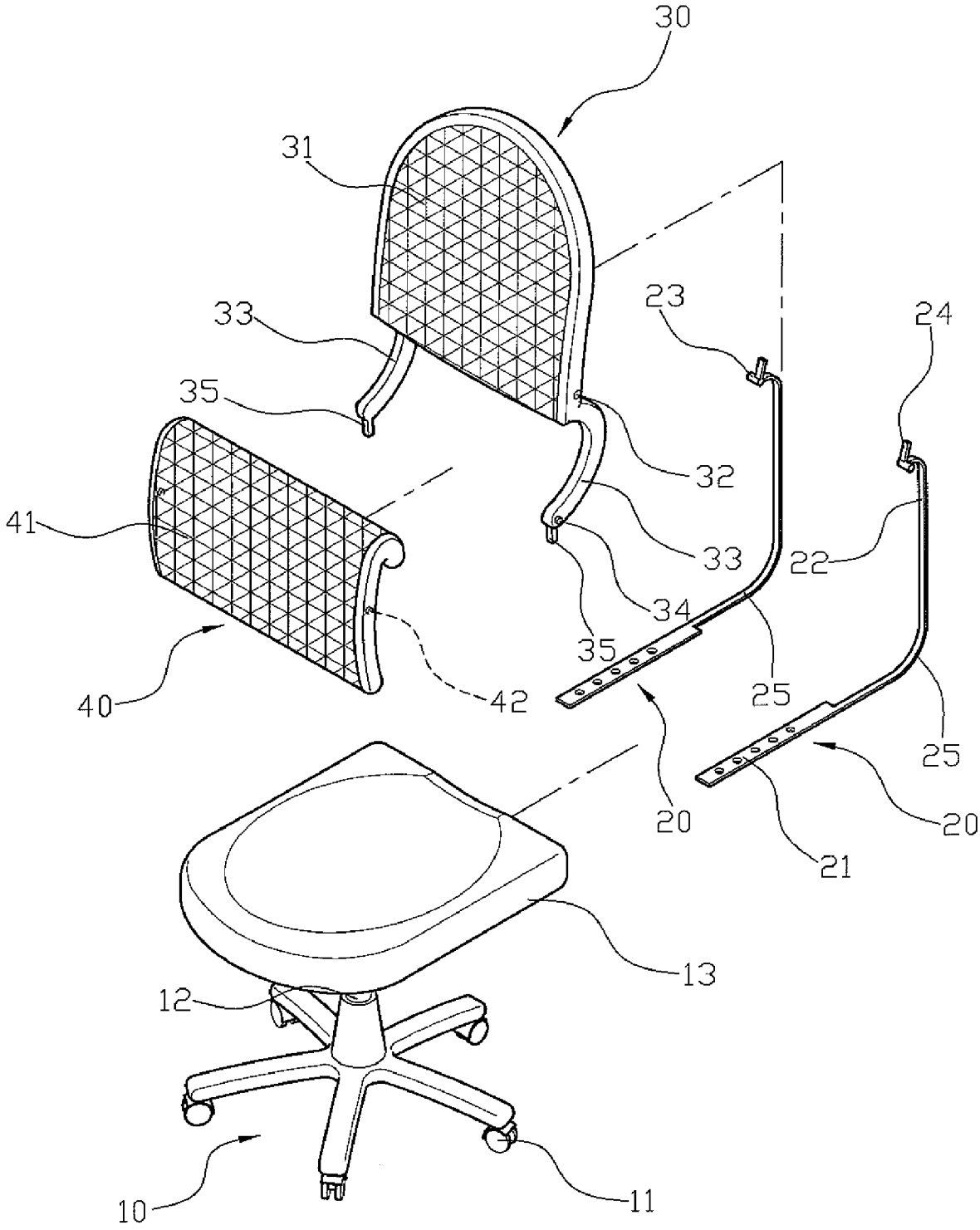
FIG. 7 is an exploded perspective view of a chair in accordance with another preferred embodiment of the present invention.
Figure 8:
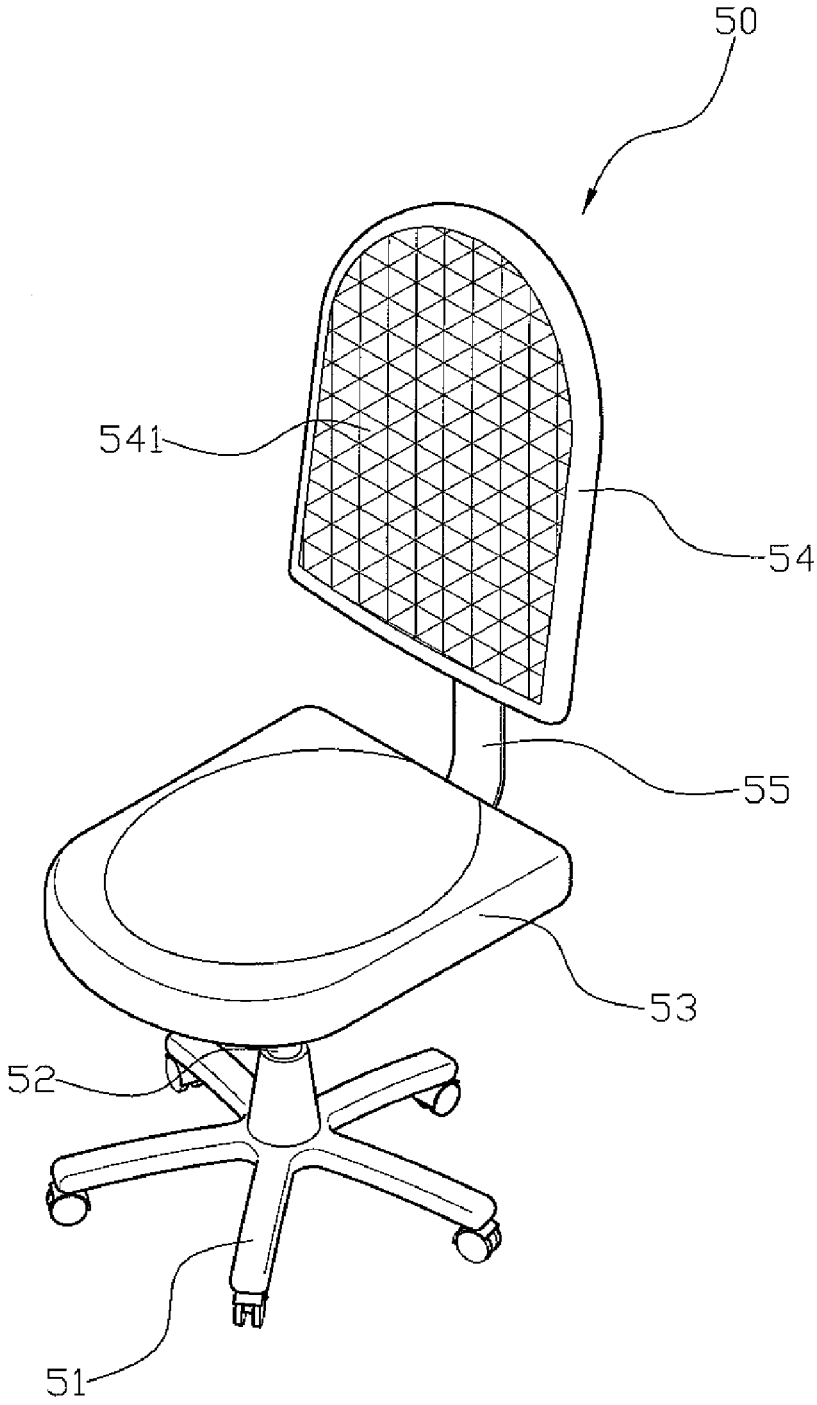
FIG. 8 PRIOR ART
FIG. 8 is a perspective view of a conventional chair in accordance with the prior art.
Figure 9:
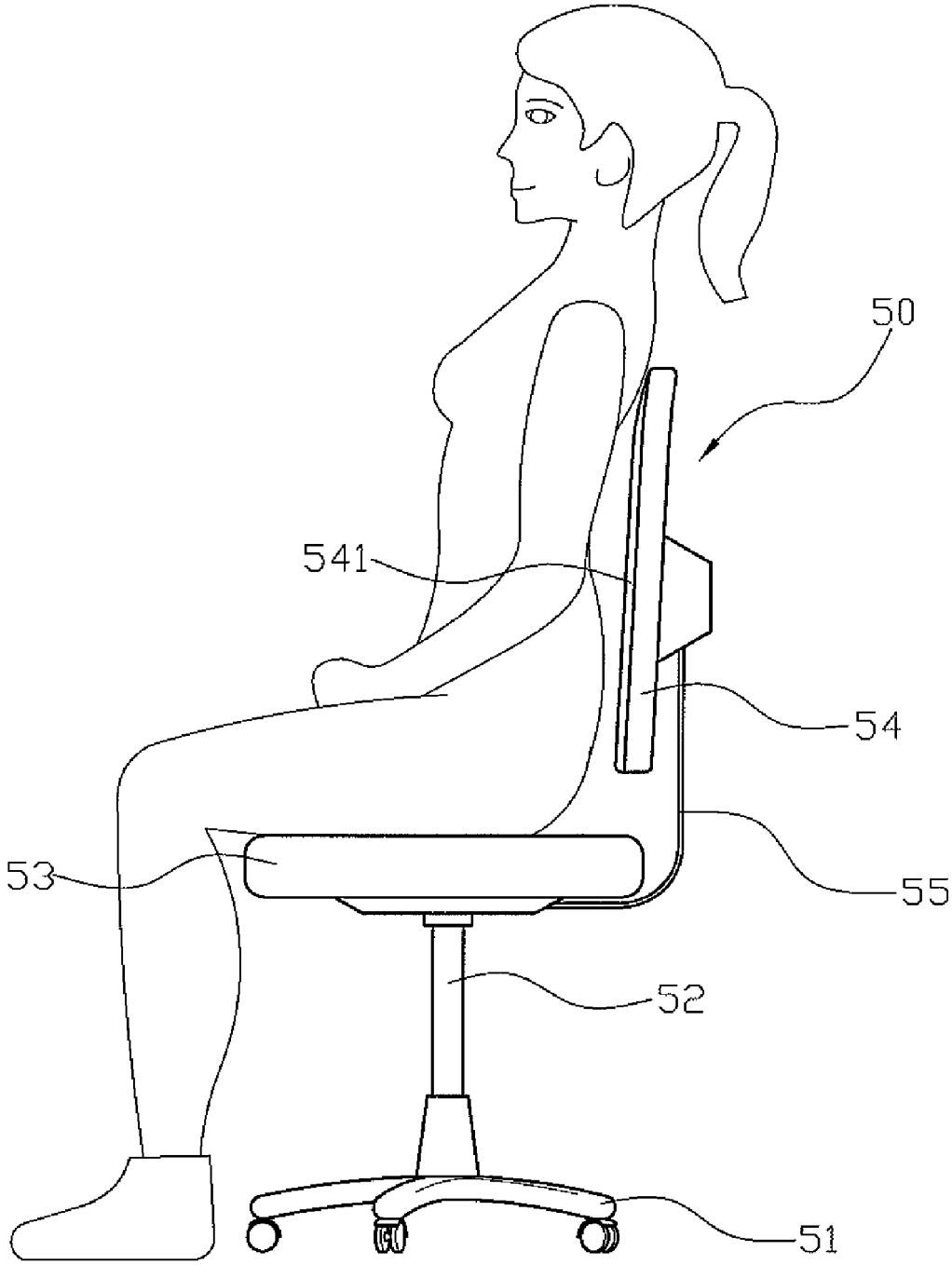
FIG. 9 PRIOR ART
FIG. 9 is a side view of the conventional chair as shown in FIG. 8.

As shown in FIG. 7, the support bracket 20 includes two substantially L-shaped parallel sheet plates 25 each having a first end formed with a horizontal fixing portion 21 secured to the seat 13 and a second end formed with an upright support portion 22. The support portion 22 of each of the sheet plates 25 of the support bracket 20 has an upper end provided with an outwardly protruding pivot shaft 23 and an upwardly protruding stop block 24 perpendicular to the pivot shaft 23. The stop block 24 of each of the sheet plates 25 of the support bracket 20 is disposed at an inclined state relative to the support portion 22 of each of the sheet plates 25 of the support bracket 20 and is inclined reward relative to the upper backrest 30. The mediate portion of the upper backrest 30 has two opposite sides each formed with a pivot hole 32 pivotally mounted on a respective pivot shaft 23 of the support bracket 20. The upper backrest 30 is pivotable relative to the support bracket 20 to rest on the stop blocks 24 of the support bracket 20 to prevent an excessive movement of the upper backrest 30 relative to the support bracket 20.

Accordingly, when a user's back is rested on the upper backrest 30 and the lower backrest 40, the upper backrest 30 and the lower backrest 40 are pivotable relative to the support bracket 20 to rest on the user's upper and lower backs respectively to support the user's whole back snugly and completely to prevent the user's lower back from depending in the air so as to provide a comfortable sensation to the user. In addition, the upper backrest 30 and the lower backrest 40 are designed ergonomically to calibrate the user's gesture. Further, the upper backrest 30 is forced by the user's upper back and pivotable relative to the pivot shafts 23 of the support bracket 20 to adjust the contact angle between the upper backrest 30 and the user's upper back, while the lower backrest 40 is forced by the user's lower back and pivotable relative to the pivot stubs 34 of the support arms 33 of the upper backrest 30 to adjust the contact angle between the lower backrest 40 and the user's lower back as to provide a more comfortable sensation to the user. Further, the upper backrest 30 is pivotable relative to the support bracket 20 to rest on the stop blocks 24 of the support bracket 20 to prevent an excessive movement of the upper backrest 30 relative to the support bracket 20.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A chair, comprising:

a base;

a seat mounted on the base;

a support bracket mounted on the seat;

an upper backrest having an upper portion pivotally mounted on the support bracket;

a lower backrest pivotally mounted on a lower portion of the upper backrest; wherein the support bracket has a first end formed with a horizontal fixing portion secured to the seat and a second end formed with an upright support portion;

the upper backrest has a mediate portion pivotally mounted on the support portion of the support bracket;

the support portion of the support bracket has an upper end provided with two opposite outwardly protruding pivot shafts;

the mediate portion of the upper backrest has two opposite sides each formed with a pivot hole pivotally mounted on a respective pivot shaft of the support bracket;

the upper end of the support portion of the support bracket is provided with two opposite upwardly protruding stop blocks each perpendicular to a respective pivot shaft;

the upper backrest is pivotable relative to the support portion of the support bracket to rest on the stop blocks of the support bracket to prevent an excessive movement of the upper backrest relative to the support portion of the support bracket.

2. The chair in accordance with claim 1, wherein the support bracket is a substantially L-shaped sheet plate.

3. The chair in accordance with claim 1, wherein the mediate portion of the upper backrest is located between the upper portion and the lower portion of the upper backrest.

4. The chair in accordance with claim 1, wherein each of the stop blocks of the support bracket is disposed at an inclined state relative to the support portion of the support bracket and is inclined reward relative to the upper backrest.

5. The chair in accordance with claim 1, wherein the support bracket includes two parallel sheet plates each having a first end formed with the horizontal fixing portion and a second end formed with the upright support portion.

6. The chair in accordance with claim 5, wherein each of the sheet plates of the support bracket is substantially L-shaped.

7. The chair in accordance with claim 1, wherein the upper portion of the upper backrest is movable rearward relative to the support bracket to pivot the upper backrest relative to the support bracket, and the lower portion of the upper backrest is movable forward relative to the support bracket to move the lower backrest forward relative to the support bracket.

8. The chair in accordance with claim 1, wherein the lower backrest is pivotable relative to the upper backrest when the upper backrest is pivotable relative to the support bracket.

9. The chair in accordance with claim 1, wherein:

the upper portion of the upper backrest is provided with a net-shaped bearing face;

the lower backrest is provided with a net-shaped bearing face corresponding to and flush with the bearing face of the upper backrest.

10. A chair, comprising:

a base;

a seat mounted on the base;

a support bracket mounted on the seat;

an upper backrest having an upper portion pivotally mounted on the support bracket;

a lower backrest pivotally mounted on a lower portion of the upper backrest;

the lower portion of the upper backrest is provided with two opposite support arms;

the lower backrest is pivotally mounted on the support arms of the upper backrest;

each of the support arms of the upper backrest has a distal end provided with an outwardly protruding pivot stub;

the lower backrest has two opposite sides each formed with a pivot bore pivotally mounted on the pivot stub of a respective support arm of the upper backrest.

11. The chair in accordance with claim 10, wherein the distal end of each of the support arms of the upper backrest is provided with a downwardly protruding catch block perpendicular to the pivot stub;

the lower backrest is pivotable relative to the support arms of the upper backrest to rest on the catch block of each of the support arms of the upper backrest to prevent an excessive movement of the lower backrest relative to the support arms of the upper backrest.

12. The chair in accordance with claim 11, wherein the each block of each of the support arms of the upper backrest is inclined reward relative to the lower backrest.

13. The chair in accordance with claim 10, wherein:

each of the support arms of the upper backrest is substantially arc-shaped;

the lower backrest is substantially arc-shaped.

14. The chair in accordance with claim 10, wherein:

each of the support arms of the upper backrest has an opening directed toward the lower backrest;

the lower backrest has an opening directed toward the support arms of the upper backrest.

15. The chair in accordance with claim 10, wherein the pivot bore of the lower backrest is located at a middle position of the lower backrest.

* * * * *